US008376085B2

(12) United States Patent
Astor et al.

(10) Patent No.: US 8,376,085 B2
(45) Date of Patent: Feb. 19, 2013

(54) ELECTRICIAN'S LADDER TOP

(75) Inventors: Kyle G. Astor, Conneaut Lake, PA (US); Marc V. Marini, Elmhurst, IL (US)

(73) Assignee: Werner Co., Greenville, PA (US)

( * ) Notice: Subject to any disclaimer, the term of this patent is extended or adjusted under 35 U.S.C. 154(b) by 432 days.

(21) Appl. No.: 11/347,613

(22) Filed: Feb. 3, 2006

(65) Prior Publication Data

US 2007/0181366 A1 Aug. 9, 2007

(51) Int. Cl.
*E06C 7/14* (2006.01)

(52) U.S. Cl. ..... 182/129; 248/238

(58) Field of Classification Search ..... 182/129; 248/240, 238, 210

See application file for complete search history.

(56) References Cited

U.S. PATENT DOCUMENTS

| | | | | |
|---|---|---|---|---|
| 529,871 | A | | 11/1894 | Minier |
| 1,794,700 | A | | 3/1931 | McCaskey |
| 3,477,679 | A | | 11/1969 | Lovitz |
| 3,915,189 | A | | 10/1975 | Holbrook et al. |
| D248,777 | S | | 8/1978 | Spencer et al. |
| 4,176,580 | A | | 12/1979 | Gallegos |
| 4,261,435 | A | | 4/1981 | Winter |
| 4,318,454 | A | | 3/1982 | Johnson |
| 4,653,713 | A | | 3/1987 | Hamilton |
| 4,714,162 | A | | 12/1987 | Harrison |
| 4,858,869 | A | | 8/1989 | Stang |
| 4,862,994 | A | | 9/1989 | Hughes, Sr. |
| 4,995,578 | A | | 2/1991 | Monheim |
| 5,035,389 | A | | 7/1991 | Wang |
| 5,052,581 | A | | 10/1991 | Christ et al. |
| 5,150,938 | A | * | 9/1992 | Gans ..... 294/156 |
| 5,158,023 | A | | 10/1992 | Allen |
| D334,240 | S | * | 3/1993 | Huffine |
| 5,240,214 | A | | 8/1993 | Birnbaum et al. |
| 5,259,480 | A | | 11/1993 | Bartnicki et al. |
| 5,263,550 | A | | 11/1993 | Jines et al. |
| 5,351,730 | A | * | 10/1994 | Lewellen et al. ..... 144/286.1 |
| 5,358,070 | A | | 10/1994 | Bartnicki et al. |
| 5,370,263 | A | | 12/1994 | Brown |
| 5,419,409 | A | * | 5/1995 | Corulla ..... 182/129 |
| 5,433,416 | A | | 7/1995 | Johnson |
| 5,460,241 | A | | 10/1995 | LaBelle |
| 5,503,245 | A | * | 4/1996 | Etesam ..... 182/129 |
| 5,547,080 | A | | 8/1996 | Klimas |
| D374,937 | S | | 10/1996 | Salas |
| 5,573,081 | A | * | 11/1996 | Bartnicki et al. ..... 182/129 |
| 5,584,357 | A | | 12/1996 | Gugel et al. |
| 5,622,278 | A | | 4/1997 | Fries et al. |
| 5,628,381 | A | | 5/1997 | Markovich et al. |
| 5,673,885 | A | | 10/1997 | Pham |
| 5,740,883 | A | | 4/1998 | Trank |
| 5,782,314 | A | | 7/1998 | Zeitler |
| 5,899,420 | A | | 5/1999 | Gerardi |
| 5,924,615 | A | | 7/1999 | McGarrah |
| 6,024,192 | A | | 2/2000 | Griffin |
| D422,717 | S | * | 4/2000 | Bartnicki et al. ..... D25/68 |

(Continued)

*Primary Examiner* — Alvin Chin Shue
(74) *Attorney, Agent, or Firm* — Ansel M. Schwartz

(57) ABSTRACT

The present invention pertains to a ladder top for a stepladder. The top comprises a plane having a front and a rear. The plane has a bin with a curved front side adjacent the front of the plane for holding small electrical parts. The plane has at least one screwdriver hole for holding the screwdriver. The plane has a hammer/drill holster slot. The plane has a pliers slot. The plane has a wire strippers slot and a channel locks slots. A method for using a ladder top for a stepladder.

11 Claims, 2 Drawing Sheets

U.S. PATENT DOCUMENTS

| | | | | |
|---|---|---|---|---|
| 6,089,383 | A * | 7/2000 | Heneveld | 211/14 |
| 6,401,862 | B1 | 6/2002 | Caron | |
| 6,412,601 | B1 | 7/2002 | Schmidt | |
| 6,443,260 | B1 | 9/2002 | Katz et al. | |
| 6,454,050 | B2 | 9/2002 | Gibson et al. | |
| 6,467,577 | B1 | 10/2002 | Charlebois, Jr. | |
| 6,481,583 | B1 * | 11/2002 | Black et al. | 211/70.6 |
| 6,502,664 | B1 | 1/2003 | Peaker, Sr. | |
| 6,591,941 | B1 | 7/2003 | Mannie | |
| D500,145 | S * | 12/2004 | Cromberg | D25/68 |
| 6,880,794 | B1 * | 4/2005 | Kahn | 248/315 |
| 7,063,187 | B1 * | 6/2006 | Lavigne | 182/129 |
| 7,077,238 | B2 | 7/2006 | Butler et al. | |
| D530,025 | S * | 10/2006 | Patton et al. | D25/68 |
| D531,322 | S * | 10/2006 | Patton et al. | D25/68 |
| 7,159,694 | B2 * | 1/2007 | Gibson | 182/165 |
| D541,433 | S * | 4/2007 | Wise | D25/68 |
| 7,341,259 | B1 | 3/2008 | Slabich et al. | |
| 2002/0017430 | A1 * | 2/2002 | Rosko | 182/129 |
| 2003/0213646 | A1 | 11/2003 | Gallion | |
| 2003/0230452 | A1 | 12/2003 | Campagna et al. | |
| 2005/0056486 | A1 * | 3/2005 | Butler et al. | 182/129 |
| 2005/0150724 | A1 | 7/2005 | Snider et al. | |
| 2005/0251213 | A1 | 11/2005 | Freeman | |
| 2007/0084669 | A1 | 4/2007 | Campagna et al. | |
| 2007/0193829 | A1 | 8/2007 | Astor et al. | |
| 2008/0142300 | A1 | 6/2008 | Roberge et al. | |
| 2009/0078504 | A1 | 3/2009 | Astor | |

* cited by examiner 1
2
3
26
5
10
Conduit Channel
1/2" - 3/4" - 1"
4
22
20
24
9
8
7
6

1
10

ELECTRICIAN'S LADDER TOP

FIELD OF THE INVENTION

The present invention is related to ladder tops. More specifically, the present invention is related to ladder tops for use by electricians.

BACKGROUND OF THE INVENTION

For years, stepladders have been designed for the general construction and painting professionals needs. The new electrician's ladder is designed for the specific needs of the electrician. New features have been added to aid in the installation of conduit, running wires, and tool storage. Specifically, the top has been redesigned to greatly benefit the electrician while on the ladder.

SUMMARY OF THE INVENTION

The present invention pertains to a ladder top for a stepladder. The top comprises a plane having a front and a rear. The plane has a bin with a curved front side adjacent the front of the plane for holding small electrical parts. The plane has at least one screwdriver hole for holding the screwdriver. The plane has a hammer/drill holster slot. The plane has a pliers slot. The plane has a wire strippers slot and a channel locks slots. The plane has a groove along the length of the top for holding tubing, pipe and conduit.

The present invention pertains to a method for using a ladder top for a stepladder. The method comprises the steps of obtaining small electrical parts from a bin in a plane with a curved front side adjacent a front of the plane. There is the step of placing at least one screwdriver in a screwdriver hole in the plane for holding the screwdriver. There is the step of placing a hammer in a hammer/drill holster slot in the plane. There is the step of placing a pliers in a pliers slot in the plane. There is the step of placing a wire strippers in a wire strippers slot in the plane. There is the step of placing channel locks in channel locks slots in the plane. There is the step of placing a conduit in a groove along a length of the plane.

The present invention pertains to a ladder top for a stepladder. The top comprises a plane having a front and a rear, the plane having at least a first bungee tool holding slot to hold a ball and bungee strap unit.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
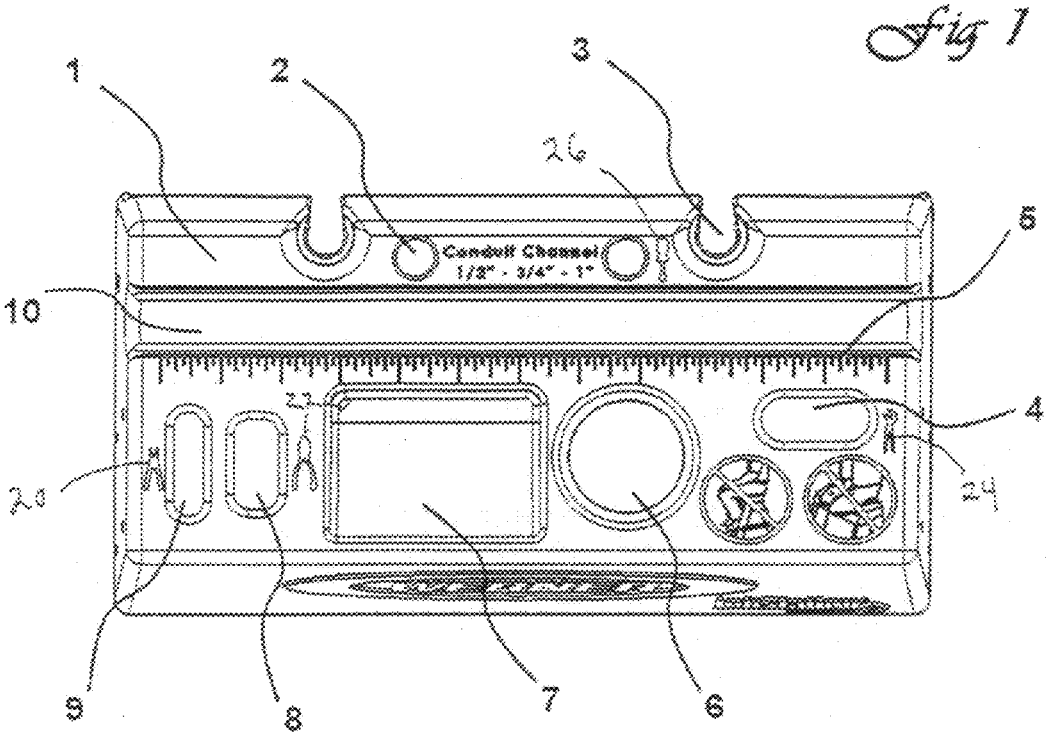
FIG. 1 is an overhead view of the ladder top of the present invention.
Figure 3:
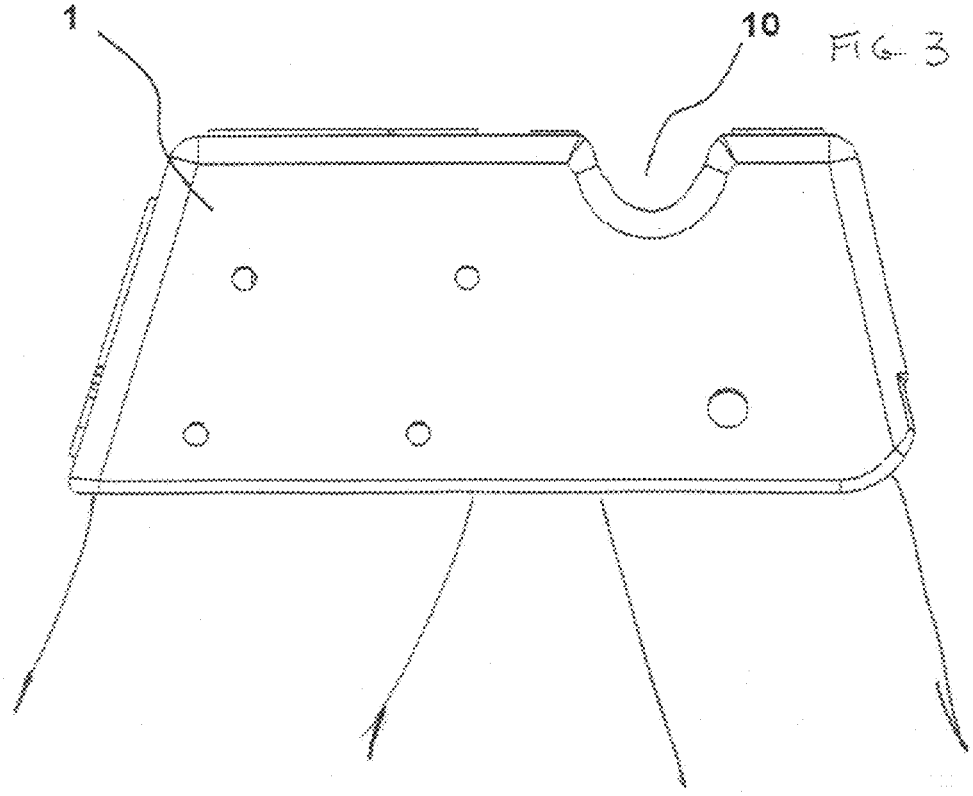
FIG. 3 is a side view of the ladder top of the present invention.
Figure 2:
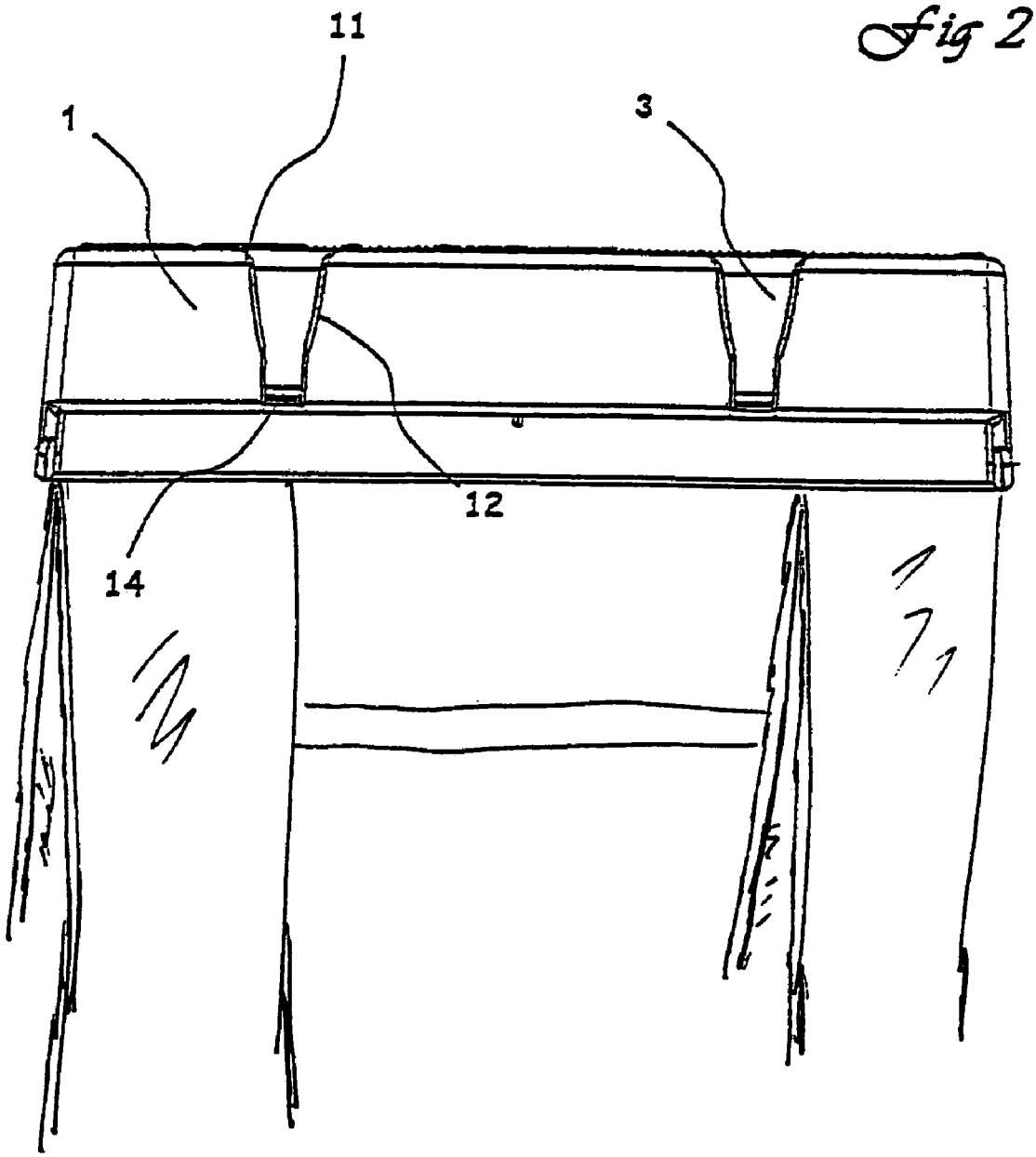
FIG. 2 is a rear view of the ladder top of the present invention.

Referring now to the drawings wherein like reference numerals refer to similar or identical parts throughout the several views, and more specifically to FIGS. 1-3 thereof, there is shown a ladder top 1 for a stepladder. The top 1 comprises a plane 24 having a front and a rear. The plane 24 has a bin with a curved front side adjacent the front of the plane 24 for holding small electrical parts. The plane 24 has at least one screwdriver hole 2 for holding the screwdriver. The plane 24 has a hammer/drill holster slot 6. The plane 24 has a pliers slot 8. The plane 24 has a wire strippers slot 9 and a channel locks slots 4. The plane has a groove along the length of the top for holding tubing, pipe and conduit.

Preferably, the plane 24 has a bungee tool holding slot 3. The plane 24 preferably has a conduit holder 10 disposed adjacent the rear of the plane 24. Preferably, the plane 24 has graduated lines 5 and for measuring items. The top 1 preferably includes a screwdriver image 26 adjacent the screwdriver slot.

The top 1 preferably includes a channel locks image 24 adjacent the channel locks slot 4, a pliers image 22 adjacent the pliers slot 8 and a wire strippers image 20 adjacent the wire strippers slot 9. Preferably, the plane 24 has a left side and a right side. The graduated lines 5 are preferably ⅛ inch intervals apart. Preferably, the image is an icon part of the plane 24 or a label.

The present invention pertains to a method for using a ladder top 1 for a stepladder. The method comprises the steps of obtaining small electrical parts from a bin in a plane 24 with a curved front side adjacent a front of the plane 24. There is the step of placing at least one screwdriver in a screwdriver hole 2 in the plane 24 for holding the screwdriver. There is the step of placing a hammer in a hammer/drill holster slot 6 in the plane 24. There is the step of placing a pliers in a pliers slot 8 in the plane 24. There is the step of placing a wire strippers in a wire strippers slot 9 in the plane 24. There is the step of placing channel locks in channel locks slots 4 in the plane 24. There is the step of placing a conduit in a groove along a length of the plane.

The present invention pertains to a ladder top for a stepladder. The top comprises a plane having a front and a rear, the plane having at least a first bungee tool holding slot to hold a ball and bungee strap unit.

Preferably, the plane has a second bungee tool holding slot. The plane preferably has a top and a bottom, and each slot is wider at the top than the bottom. Preferably, the plane has sides which extend down from the top. Each bungee slot is preferably disposed at the rear of the plane in the rear side.

In the operation of the preferred embodiment, the thermo plastic top 1 is designed for a IA extra heavy duty, reinforced fiberglass stepladder. The ladder comes in a number of different sizes.

The top 1 has many new features designed especially for the electrician. The top 1 has two screwdriver holes 2 and one hammer/drill holster 6. The top 1 also features slots 4 for channel locks, side cutters and pliers 8, and wire strippers 9. Each of the said features has a raised icon next to it for easy identification.

New bungee tool holding system slots 3 are located off of the back surface of the top 1. These slots 3 hold bungee straps that can be connected to a variety of power and non power tools electricians use daily. Once the bungee is secured to the tool, the user can place the ball end of the system into the slot 3 for storing while he is working on the ladder. The slots 3 are also able to accept accessories that are designed to fit into the slot 3 that are designed for electricians.

The groove, preferably, conduit holder 10, is located near the rear of the top 1. This holder 10 is designed to hold ½, ¾, and 1 inch as well as a plurality of other sizes. The electrician can use this conduit holder 10 to hold conduit, pipe and tubes while working on the ladder. The slots 10 give the user an extra hand and help prevent the materials from rolling off of the top 1.

The small parts tray 7 is a deep bin used to hold a variety of small parts electricians use on a daily basis. The tray 7 is curved near the front make retrieving the smaller parts easier.

Graduated lines 5 are spaced at ⅛ inch intervals to help in the rough measuring of items while up on the ladder. The lines 5 can be used to determine the length of a wide variety of objects the electrician is handling while on the stepladder.

The bungee slots 3 on the top 1 are used to hold a ball and bungee strap unit that holds tools while they are not in use. The users are often high on the ladder and tools placed on the top that are not secured have the chance of falling and injuring persons below. The user will connect his tool to the bungee strap. When the tool is not in use the user can place the ball end of the bungee strap into the slot 3 on the top. This securely holds the tools until the user is ready for them.

The slots are wider at the top 11 and then have a sloped 12 face to the ledge 14 that holds the bungee strap. The slots are optimally place at the rear of the top so tools can hang off of the back of the ladder and not injure the climber or cause an imbalance of the ladder; although the placement of the slot is up to the designer.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A stepladder comprising:

a ladder top having a plane having a front side and a rear side and a left side and a right side and a front side flange and a rear side flange and a left side flange and a right side flange, the plane having a bin for holding small electrical parts;

a groove extending along the entire length of the top and in the first side and the second side for holding tubing, pipe and conduit;

a front section having a first front rail and a second front rail in parallel and spaced relation with the first front rail and a step attached to the first and second front rail, the first front rail and the second front rail extending from the top and permanently attached to a respective side flange; and a rear section having a first rear rail and a second rear rail in parallel and spaced relation with the first rear rail, the first rear rail and the second rear rail extending from the top and permanently attached to a respective side flange, wherein said ladder top and the front and rear sections form the stepladder, wherein the plane has a periphery and a bungee tool holding slot having an opening in the periphery and a circular region that extends into the plane from the opening.

2. A stepladder as described in claim 1 wherein the groove is a conduit holder disposed adjacent the rear of the plane.

3. A stepladder as described in claim 2 wherein the top has at least one screwdriver hole for holding a screwdriver; and; a pliers hole.

4. A stepladder as described in claim 3 wherein the plane has graduated lines for measuring items.

5. A stepladder as described in claim 4 including a screwdriver image adjacent the screwdriver hole.

6. A stepladder as described in claim 5 including a hammer/drill holster image adjacent a hammer/drill holster hole.

7. A stepladder as described in claim 6 including a channel locks image adjacent a channel locks hole, a pliers image adjacent the pliers hole and a wire strippers image adjacent a wire strippers hole.

8. A stepladder as described in claim 1 wherein the plane has a top and a bottom, and the bungee tool holding slot is wider at the top than the bottom.

9. A stepladder as described in claim 8 wherein the graduated lines are ⅛ inch intervals apart.

10. A stepladder as described in claim 9 wherein each image is an icon part of the plane or a label.

11. A stepladder as described in claim 9 wherein the bungee slot is disposed at the rear of the plane.

* * * * *